US005784798A

United States Patent [19]

Taylor

[11] Patent Number: 5,784,798

[45] Date of Patent: Jul. 28, 1998

[54] IMPLEMENT FOR SUPPORTING PAINT-ROLLER SLEEVES

[76] Inventor: David Brian Taylor, 4 Farndale Road, Milton, Weston Super Mare, BS22 9QA, Great Britain

[21] Appl. No.: 776,339

[22] PCT Filed: Jul. 26, 1995

[86] PCT No.: PCT/GB95/01769

§ 371 Date: Jan. 27, 1997

§ 102(e) Date: Jan. 27, 1997

[87] PCT Pub. No.: WO96/03287

PCT Pub. Date: Feb. 8, 1996

[30] Foreign Application Priority Data

Jul. 28, 1994 [GB] United Kingdom ..... 9415201

[51] Int. Cl.[6] ..... F26B 17/24

[52] U.S. Cl. ..... 34/58; 285/346

[58] Field of Search ..... 34/58, 312, 314, 34/318; 15/230.11; 134/900; 429/19; 16/115; 192/79, 107 T; 285/341, 346, 354

[56] References Cited

U.S. PATENT DOCUMENTS

| | | | |
|---|---|---|---|
| 2,794,265 | 6/1957 | Kruger | 34/58 |
| 2,970,366 | 2/1961 | Gill | 492/19 |
| 3,229,319 | 1/1966 | Goetz | 15/230.11 |
| 3,467,400 | 9/1969 | MacKenzie et al. | 34/58 |
| 3,745,624 | 7/1973 | Newman | 15/230.11 X |
| 3,986,737 | 10/1976 | Krusche | 285/341 |
| 4,130,443 | 12/1978 | Dulin | 134/33 |
| 5,185,938 | 2/1993 | Hutt | 34/58 |
| 5,238,012 | 8/1993 | Coronato | 134/140 |
| 5,269,039 | 12/1993 | Isaac | 15/230.11 |
| 5,458,144 | 10/1995 | Lavine | 135/24 |
| 5,621,979 | 4/1997 | Taylor | 34/58 |

FOREIGN PATENT DOCUMENTS

| | | |
|---|---|---|
| 2693387 | 1/1994 | France . |
| 2155147 | 9/1985 | United Kingdom . |
| 9200200 | 1/1992 | WIPO . |

*Primary Examiner*—Henry Bennett
*Assistant Examiner*—Steve Gravini
*Attorney, Agent, or Firm*—Glifford, Krass, Groh, Sprinkle, Patmore, Anderson & Citkowski, P.C.

[57] ABSTRACT

An implement (10) for supporting selectively each of at least two roller sleeves of different internal diameters for rotation about their axes comprises an elongate support (11) adapted to extend through each sleeve and carrying two supports (15, 21) for supporting the smaller-diameter sleeve (20) adjacent its ends, a mount (16) for supporting one end of the larger-diameter sleeve and adapter means (30) engageable with a support (21) for the smaller-diameter sleeve for supporting the opposite end of the larger-diameter sleeve, the adapter means and one support (21, 30) for the smaller sleeve being a resilient force fit in the respective sleeve to connect the sleeve for rotation with the elongate support (11).

13 Claims, 3 Drawing Sheets

IMPLEMENT FOR SUPPORTING PAINT-ROLLER SLEEVES

The present invention relates to implements for supporting paint-roller sleeves for rotation, particularly but not exclusively for cleaning.

It is known to clean paint-roller sleeves by soaking them in a suitable solvent and rotating them about their longitudinal axes to expel the paint and solvent therefrom centrifugally. Various implements are known for supporting such sleeves for rotation, either on or detached from their rollers, the rotation being effected either manually or by a motor, for example by the motor of an electric drill. Such implements are not, however, widely available.

A complicating factor in the production of such implements lies in the fact that paint rollers are available in different sizes. The implements themselves must, therefore, either be made in different sizes to accommodate different rollers or roller sleeves, or they must be adaptable in some way to accommodate rollers or sleeves of different sizes. The provision of such different or adaptable implements adds to the manufacturing costs.

The object of the present invention is to provide an implement which is convenient to use and adaptable to support different sized roller sleeves for rotation but which can be manufactured more cheaply than prior art such implements so that it may be made more widely available.

Accordingly, the present invention provides an implement for supporting selectively each of at least two roller sleeves of different internal diameters for rotation about their axes, the implement comprising an elongate support adapted to extend through each sleeve and having support means for supporting the smaller-diameter sleeve at two longitudinally-spaced positions, the elongate support also being adapted or adaptable to support the larger-diameter sleeve at a first position and the implement further including adapter means engageable with the support means for the smaller-diameter sleeve and adapted, when so engaged, to support the larger-diameter sleeve at a second position spaced from the first position.

The invention provides a very simple way of adapting a support to carry different sized sleeves and, in a preferred embodiment, the adaptor means and at least the part of the elongate support carrying the support means for the sleeves may be manufactured very cheaply by moulding from plastics material. Although the invention has been devised particularly with a view to providing an implement for facilitating the cleaning of paint-roller sleeves it could alternatively be used as part of a paint-roller body for supporting respective sleeves for use in painting and decorating. In this latter case the sleeve support means would support the respective sleeve for rotation relative to the elongate body, or a shaft extending therethrough, and the implement would, in most cases have, a handgrip at one end. This use could reduce manufacturing costs for manufacturers currently making different sized rollers for different markets or could enable a purchaser to buy a single roller body and equip it with different sleeves for different painting tasks.

In the preferred form of the implement, however, to which reference will be made below and in which its intended use is for cleaning roller sleeves, the support means are adapted to connect a roller sleeve supported thereby to the elongate support for rotation therewith and the elongate support is adapted at one end for engagement with a drive for rotating it about its axis.

The implement of the invention could readily be adapted to support more than two different-diameter paint-roller sleeves by the provision of additional support means but two particular sizes of rollers are most commonly available on the market and the implement is preferably arranged to support these two sleeve sizes.

In practice the implement of the invention is adapted to support each sleeve to be carried thereby at or adjacent each end in order to minimise any wobbling of the sleeve on the support during rotation. The support means may be adapted to grip the sleeve ends but may simply comprise or include bodies which are a close fit at least in one end.

The support for the two sleeves is preferably provided by respective mounts adjacent that end of the elongate support adapted to receive the rotary drive and a further mount at or adjacent the opposite end of the support for supporting the opposite end of the smaller-diameter sleeve or for receiving the adapter means for the larger-diameter sleeve, although it will be appreciated that these positions could be reversed. Alternatively both mounts for the smaller sleeve could be adaptable to receive the larger sleeve by means of adapters. Preferably both the smaller- and the larger-diameter sleeves can be fitted over the said further mount and slid axially along the support into engagement with their respective said mounts.

A mount for one end of each sleeve may comprise a conic frustum engageable by the respective ends of the two sleeves in spaced positions but it is preferred to provide support over wider, generally cylindrical surfaces.

Various ways of providing such support surfaces may be envisaged: they may, for example, by defined by the ends of radial fingers projecting from the support. Moreover the larger-diameter surface may comprise the outer surface of a sleeve which coaxially surrounds the smaller diameter surface, being spaced therefrom by a sufficient clearance to accommodate the end of the smaller-diameter roller sleeve. Conveniently, however, both surfaces are surfaces of coaxial cylindrical bodies carried by the elongate support. The two bodies are preferably joined at an annular shoulder which provides an abutment for the end of the smaller sleeve when it is fitted onto the support. The support is preferably also provided with a further annular shoulder for abutment by the larger-diameter sleeve.

The other support for the smaller-diameter sleeve is preferably also a cooperating fit in the sleeve but is preferably radially compressible such as to exert a resilient force on the interior of the sleeve sufficient to connect it frictionally with the support for rotation therewith. The adapter is preferably a force fit on this support in a similar manner while the larger-diameter sleeve is preferably also a cooperating force-fit on the adapter so as to connect it for rotation with the adapter and, therethrough, with the support. The adapter is preferably resiliently snap-engageable with the support means to retain it thereon in use. It may, but need not necessarily be releasable from the support means since the purchaser will in most cases require it to support only one size of roller sleeve.

Various ways of forming this other support for the smaller sleeve may be envisaged. It may, for example, be a body of foamed plastics material but in a preferred embodiment it comprises a substantially tubular body coaxially surrounding but spaced from the elongate support, the body preferably being constituted by a plurality of axially-extending tongues spaced apart by slots such that they can flex resiliently towards and away from the support itself. The adapter is preferably in the form of a cap which fits axially onto the said tubular body and may be releasably attachable thereto or substantially irreleasable once fitted. Clearly if an implement in accordance with the invention were required to support a further paint-roller sleeve having a different diameter, alternative adapters could be provided for attachment to the second support means or additional adapters could be fitted over the adapter mentioned above.

One embodiment of a sleeve-cleaning implement in accordance with the invention will now be more particularly described by way of example with reference to the accompanying drawings, in which.

Figure 1:
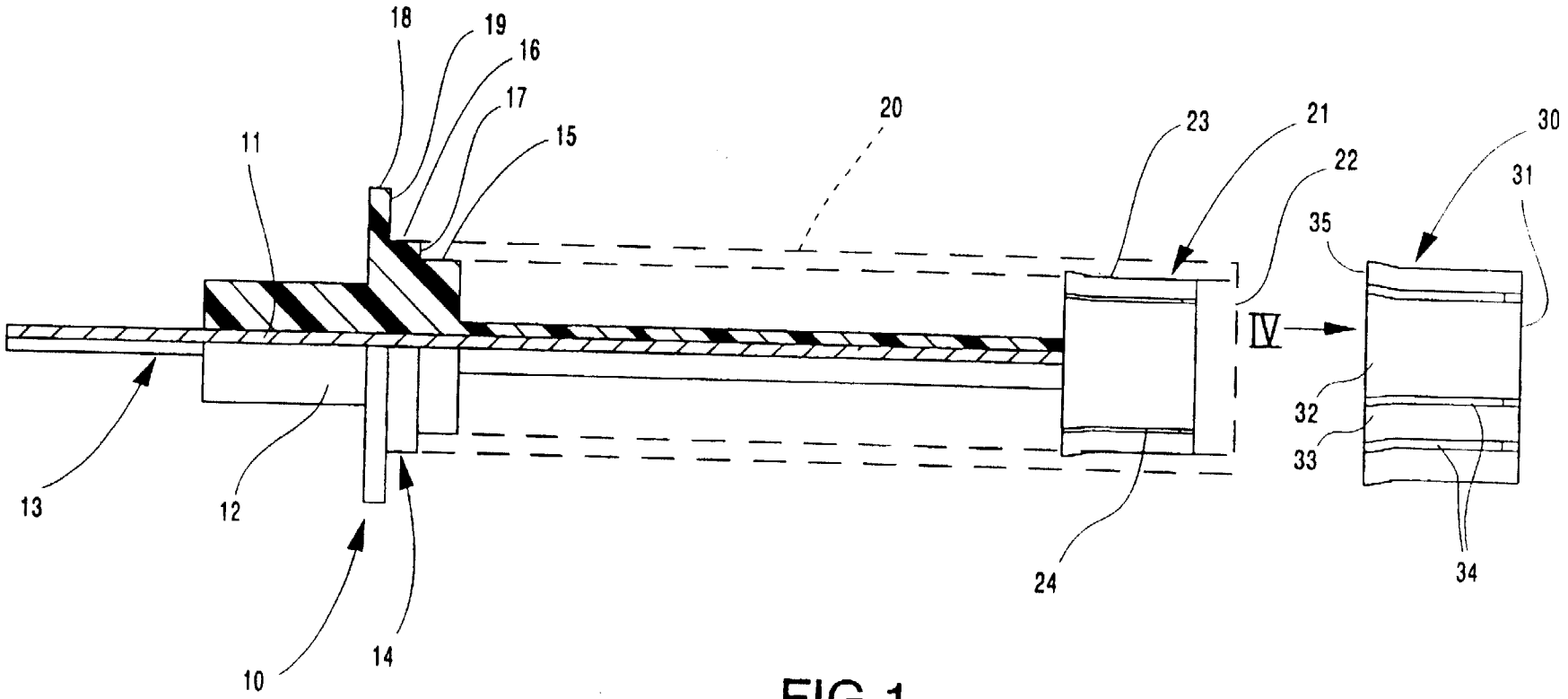
FIG. 1 is a part axially-sectioned side elevational view of an implement with a cover portion detached.
Figure 2:
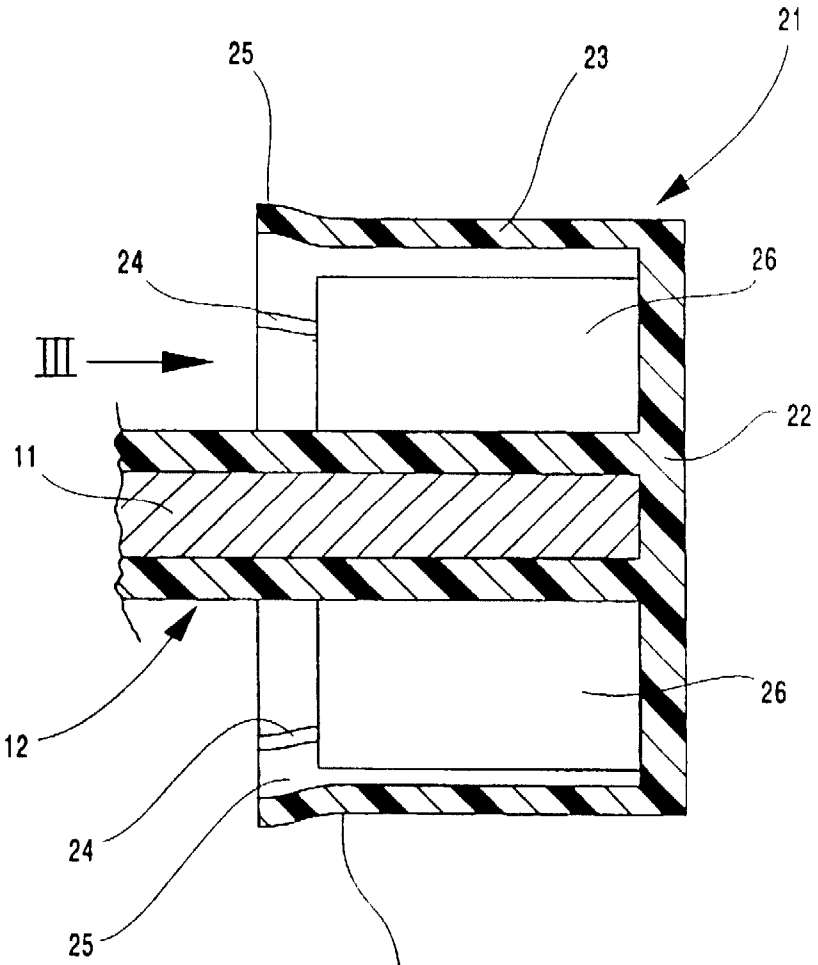
FIG. 2 is an axial sectional view of an end portion of the implement of FIG. 1 on an enlarged scale.
Figure 3:
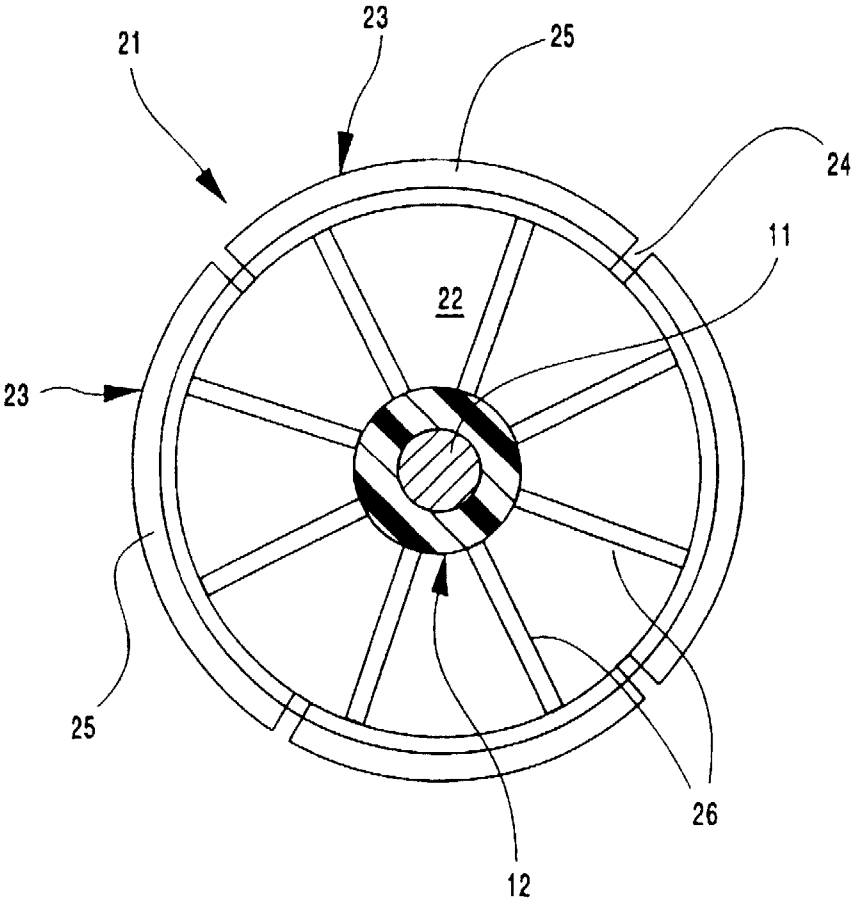
FIG. 3 is a view taken in the direction of the arrow III of FIG. 2.

With reference to the drawings, an implement for supporting either of two paint-roller sleeves of two different diameters for cleaning is generally indicated 10. The implement 10 comprises an elongate, cylindrical steel rod 11 substantially entirely surrounded by a plastics sheath 12 but with one end portion 13 projecting therefrom for gripping by the chuck of an electric drill or the like (not shown) for rotating the implement about the axis of the rod 11.

The sheath 12 is formed in an intermediate position along its length, but nearer the free end portion 13 of the rod 11, with a coaxial, circumferentially projecting sleeve-support body 14 with a cylindrically stepped surface. The sleeve supported body 14 thus has a first portion 15 of least diameter furthest from the rod end 13 adjoining an intermediate-diameter portion 16 at a radial shoulder 17. The intermediate diameter portion 16 in turn adjoins the largest-diameter portion 18 at a radial shoulder 19. The smallest-diameter portion 15 is of such a size that it is a close fit inside a smaller-diameter paint-roller sleeve, shown in broken outline and indicated 20 in FIG. 1, whereas the intermediate-diameter portion 16 is a close fit in a slightly larger-diameter paint-roller sleeve not shown.

The end of the sheath 12 remote from the rod end 13 is formed with a second sleeve support generally indicated 21 for supporting the opposite end of the smaller-diameter roller sleeve 20 from that supported by the first sleeve-support portion 15. The second sleeve support 21 comprises a circular end wall 22 coaxial with the rod 11 and a generally cylindrical, resiliently-flexible skirt constituted by arcuate tongues 23 projecting axially from the periphery of the end wall 22 towards the first sleeve support body 14 and separated by axially extending slits 24. The tongues 23 terminate in lips 25 which are turned slightly outwardly.

Each tongue 23, in addition to being supported at one end by the end wall 22, is also supported by two internal radial struts 26 extending from the sheath 12 to the tongue itself.

In use of the implement shown in the drawings with a smaller-diameter roller sleeve, the sleeve 20 may be force-fitted axially over the second support 21 until one end is fitted over the first sleeve-support portion 15 and abuts the shoulder 17. The tongues 23 with their supporting struts 26 have sufficient resilience to deform radially inwardly of the sleeve to allow this force-fitting while the frictional engagement of the portion 15 and of the resilient tongues 23 with the interior of the roller sleeve is sufficient to connect the roller sleeve to the implement for rotation therewith when the rod 11 is rotated by a rotary drive.

Figure 4:
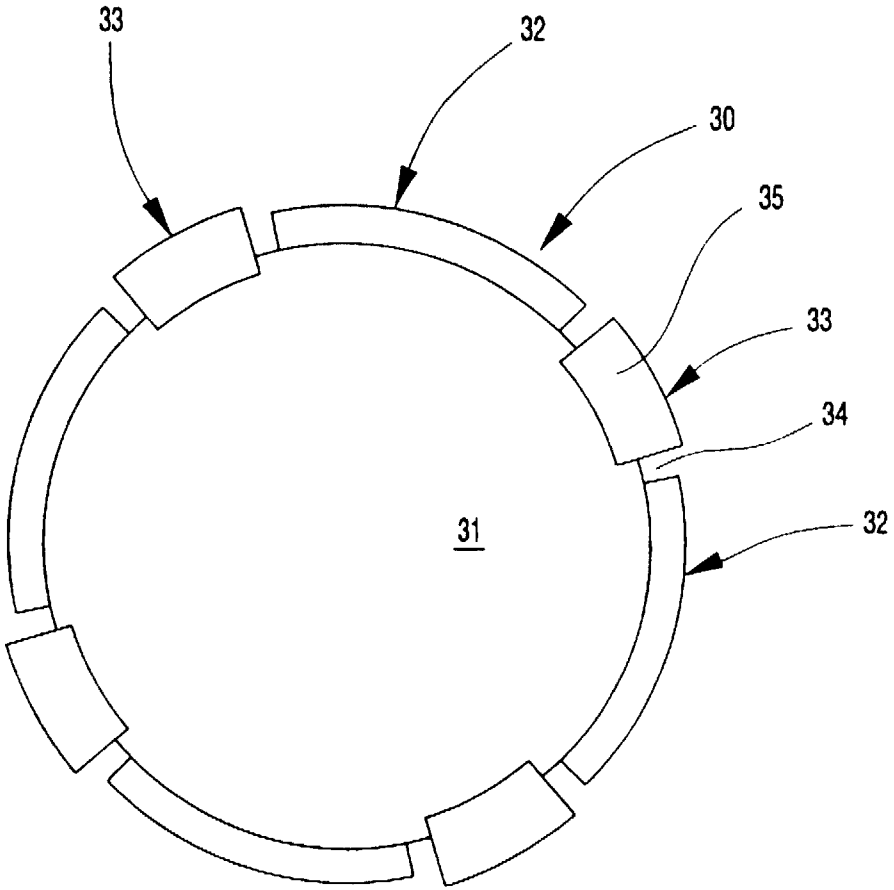
FIG. 4 is a view of an end cap of the implement of FIG. 1 on the same scale as FIG. 3, taken on the arrow IV of FIG. 1.

If the implement 10 is to be used with a roller sleeve of larger diameter than the sleeve 20 shown in FIG. 1, an end cap shown in FIGS. 1 and 4 at 30 must be added. The end cap 30 is of similar construction to the support 21 in that it has an end wall 31 and a generally cylindrical, resiliently-flexible skirt defined by arcuate tongues 32,33 separated by axially-extending slits 34. The cap 30 is, however, completely hollow not having any internal strengtheners like the struts 26 so that it can be force-fitted axially over the second sleeve support 21. Moreover the tongues 32, 33 of the cap 30 are slightly longer than the tongues of the second sleeve support 21 and alternate tongues 33 terminate in inwardly projecting lips 35 such that, when the cap 30 is fully fitted on to the second sleeve support 21, the lips 35 snap-engage over the flared lips 25 of the tongues 23 to retain the cap 30 firmly in position.

The external diameter of the cap 30 is substantially the same as that of the intermediate portion 16 of the first support body 14 so that a larger-diameter roller sleeve can be force fitted over the cap 30 and along the rod 11 until it engages the support portion 16 with its end abutting the shoulder 19. In this position the sleeve is supported for rotation with the implement 10 in the same manner as explained for the roller sleeve 20.

The cap 30 may be releasable from the second sleeve support 21 but, in general, a purchaser is likely to have roller sleeves of one diameter only and will therefore fit the cap 30 to the support 21 substantially permanently if he wishes to use it with larger-diameter sleeves.

In the drawings, the second end support 21 is shown with four skirt tongues 23 separated by narrow slits 24 and supported by the end wall 22 and the struts 26. It will be understood, however, that the number and shape of the tongues, their separation and their mode of support may be varied widely. Likewise, the cap 30 is shown with four tongues 32 of larger arcuate extent alternated with four smaller tongues 33 provided with the snap-engaging, inwardly-projecting lips 35: it could however be formed with different numbers and shapes of tongues, all or only some with inwardly-turned lips.

For convenience of manufacture, the sheath 12 with its sleeve supports is integrally moulded on the rod 11 while the cap 30 is also moulded as a separate unit.

I claim:

1. An implement for supporting selectively each of at least two roller sleeves of different internal diameters for rotation about an axis established by each roller sleeve, the implement comprising an elongate support adapted to extend through a selected roller sleeve and having support means for supporting the smaller-diameter roller sleeve at two longitudinally-spaced positions, the elongate support also being adapted to support the larger-diameter roller sleeve at a first position and the implement further including adapter means engageable with the support means for the smaller-diameter roller sleeve and adapted, when so engaged to the support means, to support the larger-diameter roller sleeve at a second position spaced from the first position, both the support means and the adapter means being resiliently and radially compressible to engage the selected roller sleeve frictionally at the second position.

2. The implement of claim 1, in which the support means are adapted to connect a roller sleeve supported thereby to the elongate support for rotation therewith and the elongate support is adapted at one end for engagement with a drive for rotating it about its axis.

3. The implement of claim 1, in which the support means comprise first and second mounts carried by the elongate support at spaced-apart positions for supporting the smaller-diameter roller sleeve proximate to its ends.

4. The implement of claim 3, in which the elongate support has a third mount adjacent the first mount for supporting the larger-diameter roller sleeve at or adjacent one end, the adapter means being engageable with the second mount to support the opposite end of the larger-diameter roller sleeve.

5. The implement of claim 4, in which the first and third mounts comprise two cylindrical support bodies located coaxially adjacent each other on the elongate support and each being a close fit in the respective roller sleeve, the bodies being so located that the larger-diameter body provides an annular shoulder for abutment by the end of the smaller diameter roller sleeve when fitted axially along the support onto the smaller diameter body in use.

6. The implement of claim 5, in which a further cylindrical body of larger diameter than the third mount is located coaxially adjacent thereto on the elongate support to define a shoulder for abutment by the end of the larger-diameter sleeve fitted axially onto the third mount.

7. The implement of claim 3, in which the second mount comprises a plurality of resiliently flexible tongues carried by the elongate support so as to be spaced therefrom, the tongues extending generally axially of the support and circumferentially surrounding it but being spaced apart from each other to allow their flexing towards the support for force fitting into the respective sleeve.

8. The implement of claim 3, in which the adapter means is a cooperating force fit on the second mount and is also a cooperating force fit in the larger-diameter roller sleeve so as to connect the larger-diameter sleeve for rotating with the second mount in use.

9. The implement of claim 8, in which the adapter means comprise a cap having an end wall supporting a skirt formed by a plurality of resiliently-flexible tongues spaced apart by axial slots, the skirt being a force fit on the second mount.

10. The implement of claim 1, in which the adapter means and the support means have mutually snap-engageable formations for retaining the adapter means in engagement with the support means.

11. The implement of claim 2, in which the support means for the smaller-diameter roller sleeve and a support for the larger-diameter roller sleeve are integrally moulded from a plastic material with at least a portion of the elongate support.

12. The implement of claim 2, in which the support means comprise first and second mounts carried by the elongate support at spaced-apart positions for supporting the small-diameter sleeve at or adjacent its ends.

13. The implement of claim 7, in which the adapter means is a cooperating force fit on the second mount and is also a cooperating force fit in the larger-diameter sleeve so as to connect the larger-diameter sleeve for rotation with the second mount in use.

* * * * *